US008393819B2

(12) United States Patent
Warmus

(10) Patent No.: US 8,393,819 B2
(45) Date of Patent: Mar. 12, 2013

(54) BINDER APPARATUS

(75) Inventor: James Warmus, La Grange, IL (US)

(73) Assignee: Moore Wallace North America, Inc., Chicago, IL (US)

( * ) Notice: Subject to any disclaimer, the term of this patent is extended or adjusted under 35 U.S.C. 154(b) by 238 days.

(21) Appl. No.: 12/945,465

(22) Filed: Nov. 12, 2010

(65) Prior Publication Data

US 2012/0121318 A1 May 17, 2012

(51) Int. Cl.
*B42F 3/04* (2006.01)

(52) U.S. Cl. ..... 402/37

(58) Field of Classification Search ..... 402/19, 402/35, 31, 38, 41
See application file for complete search history.

(56) References Cited

U.S. PATENT DOCUMENTS

| | | | | |
|---|---|---|---|---|
| 6,206,601 | B1 * | 3/2001 | Ko | 402/38 |
| 6,840,695 | B2 | 1/2005 | Horn | |
| 6,916,134 | B2 | 7/2005 | Wong | |
| 7,404,685 | B2 * | 7/2008 | Cheng | 402/38 |
| 7,534,064 | B2 | 5/2009 | Cheng | |
| 7,648,302 | B2 | 1/2010 | Zhang et al. | |
| 7,661,898 | B2 | 2/2010 | Ng et al. | |
| 7,661,899 | B2 | 2/2010 | Lin | |
| 7,665,926 | B2 | 2/2010 | Cheng | |
| 7,704,005 | B2 | 4/2010 | Lin | |
| 7,726,897 | B2 | 6/2010 | To et al. | |
| 7,731,441 | B2 | 6/2010 | Ng et al. | |
| 7,744,300 | B2 | 6/2010 | Cheng et al. | |
| 7,758,271 | B2 | 7/2010 | Cheng | |
| 7,828,491 | B2 | 11/2010 | Cheng | |
| 2005/0201818 | A1 | 9/2005 | Cheng | |
| 2008/0075527 | A1 | 3/2008 | Pi et al. | |
| 2009/0060631 | A1 | 3/2009 | To et al. | |
| 2009/0274508 | A1 | 11/2009 | Zhang et al. | |
| 2010/0232867 | A1 | 9/2010 | Ng et al. | |

* cited by examiner

*Primary Examiner* — Dana Ross
*Assistant Examiner* — Matthew G Katcoff
(74) *Attorney, Agent, or Firm* — Hanley, Flight & Zimmerman, LLC

(57) ABSTRACT

Binder apparatus are described. An example binder apparatus includes a housing comprising a plurality of lateral recesses or apertures and a first carrier rail having a first longitudinal edge and a second longitudinal edge, the housing engaging the first longitudinal edge. The example binder apparatus includes a second carrier rail having a third longitudinal edge and a fourth longitudinal edge, the housing engaging the third longitudinal edge, the second longitudinal edge hingably engaging the fourth longitudinal edge. The binder apparatus includes a slider comprising a plurality of protrusions to be received by at least some of the lateral recesses or apertures.

23 Claims, 12 Drawing Sheets

BINDER APPARATUS

FIELD OF THE DISCLOSURE

This patent relates to binders and, more specifically, to binder apparatus.

BACKGROUND

Binders are used to store loose leaf pages, documents, other materials, etc.

DETAILED DESCRIPTION

Figure 1:
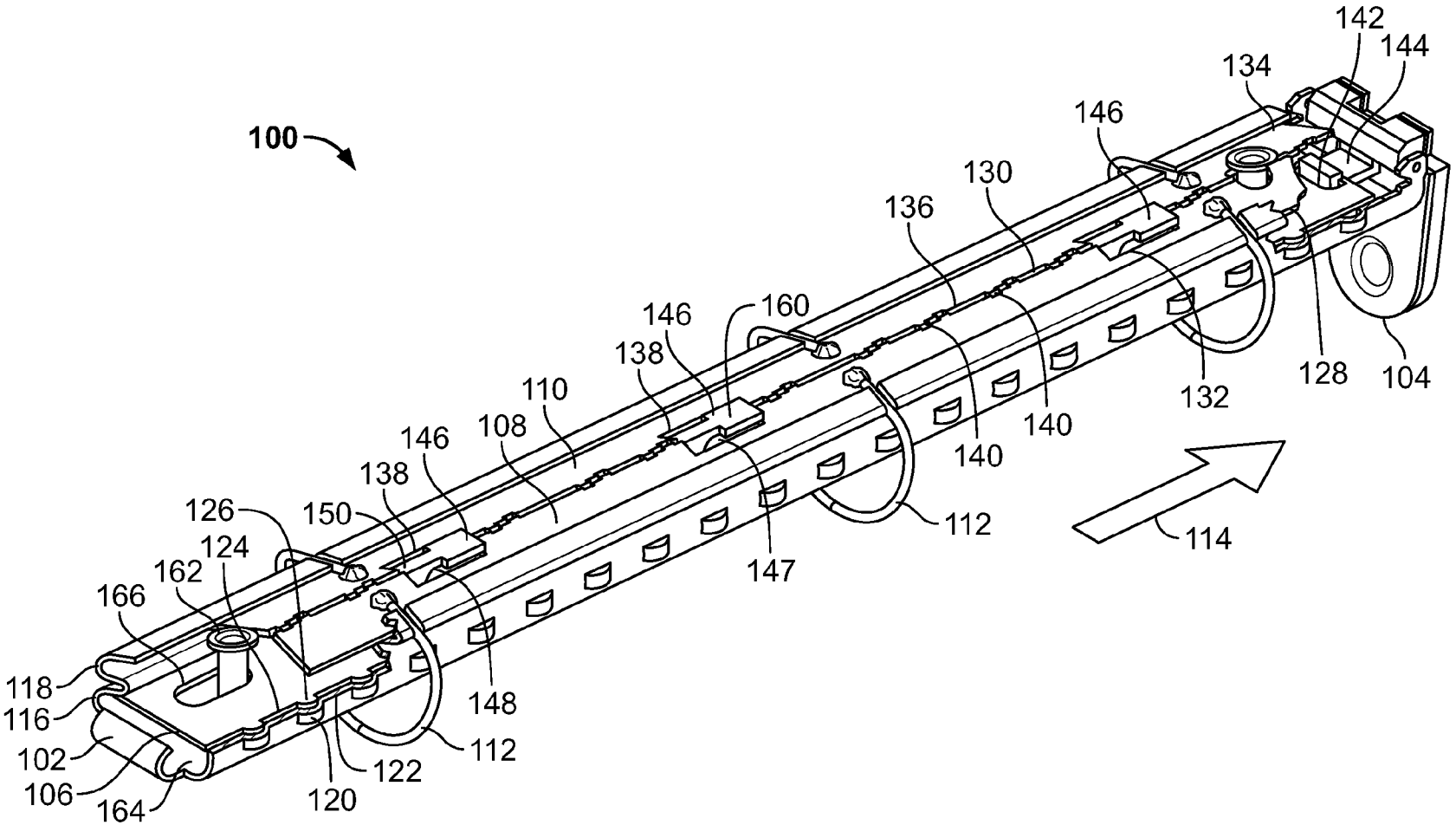
FIGS. 1-3 depict different positions of an example binder apparatus.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

The examples described herein relate to example binder apparatus that provide increased tension to secure closure members of such binder apparatus in either an open position or a closed position while still enabling these closure members to be easily moved between either of these positions. More specifically, the example binder apparatus decreases tension effectively exerted on the closure members when the closure members are moving between the open and closed positions and increases the tension effectively exerted on the closure members once the closure members are positioned in either the open or closed position. By decreasing the tension effectively exerted on the closure members when the closure members are moving between the open and closed positions, the spring effect encountered when opening and closing known binder mechanisms may be reduced and/or substantially eliminated making the example binder apparatus easier to open and/or close.

In some examples, the binder apparatus includes a housing having a first lobe in which a plurality of carrier rails are positioned and a second lobe in which a slider is positioned. The lobes may be similarly or differently sized. The slider may be operatively coupled to a lever that longitudinally moves the slider to different positions associated with securing and/or moving the carrier rails. The carrier rails may be moved by the lever and/or vertical tabs of the slider depending on the configuration of the binder apparatus. Associated closure members may be coupled to the carrier rails and may form a circular closure, a D-shaped closure, etc. when the closure members are in the closed position.

The slider and the housing may include structures that are configured to be in-sync with one another when the carrier rails are in either the open or closed position and to be out-of-sync with one another at least part of the time as the carrier rails are moving between the open and closed positions. The distance between successive structures on the slider and the housing may correspond to an amount of travel sufficient to move the carrier rails between the open position and the closed position and/or between the open or closed position and an intermediate position.

Additionally or alternatively, the distance between successive structures on the slider and the housing may be configured to minimize tension exerted on the carrier rails by the housing when moving the carrier rails between the open and closed positions and to maximize tension exerted on the carrier rails when the carrier rails are in either the open or closed position. To increase the tension exerted on the carrier rails by the housing when the carrier rails are in either the open or closed position, an amount that the structures laterally extend (e.g., a depth of the structures) may be increased or changed.

The structures of the slider may be similar or different than the structures of the housing. If the structures of the slider and the housing have a similar size and/or shape, as the slider is moved to the open position from the closed position, for example, the housing may respond by expanding substantially immediately. If the structures of the slider and the housing have a different size and/or shape, as the slider is moved to the closed position from the open position, for example, the housing may remain in a relaxed state for a period of time prior to expanding. In other examples, if the structures of the slider and the housing have a different size and/or shape, as the slider is moved to the open position from the closed position, for example, the housing may respond by expanding substantially immediately but may then return to a relaxed state prior to the closure members being in the open position. In other examples, if the structures of the slider and the housing have a different size and/or shape, as the slider is moved to the open position from the closed position, for example, the housing may remain in a relaxed state for a period of time prior to expanding and, after being in the expanded state, the housing may return to a relaxed state prior to the closure members being in the open position. While a few example configurations of housing/slider structures are described above, other configurations may be utilized to control the position of the housing (e.g., an expanded position, a relaxed position) as the slider is moved relative to the housing.

In some examples, the structures of the slider may include protrusions, bumps and/or recesses and the structures of the housing may include recesses, bumps and/or apertures. In either the open or closed position, the structures of the slider may be received by and/or in-sync with at least some of the structures of the housing. Thus, in either the open or closed position, the housing is in a relaxed state and forms a relatively tight fit relative to the carrier rails. This tight fit increases an amount of tension and/or force exerted on the carrier rails preventing them from inadvertently opening and/or closing.

When moving between the open and closed positions, the structures of the slider may be out of alignment and/or sync with the structures of the housing during at least some of this movement. Having the structures out-of-sync with one another expands the second lobe in which the slider is positioned which in turn expands the first lobe in which the carrier rails are positioned. Thus, as the carrier rails are moving between the open and closed positions, the housing may be in an expanded state that decreases the amount of tension exerted on the carrier rails. This decreased tension enables a person to more easily move the carrier rails between the open and closed positions and/or between the open or closed position and an intermediate position.

In other examples, the binder apparatus includes a slider and a housing having a lobe in which a plurality of carrier rails are positioned. As with the examples described above, the housing and the slider include structures that interact to control tension exerted on the carrier rails. To retain the slider relative to the housing, the slider and/or the housing include retaining structures. In some example, the retaining structures are grooves of the slider that receive surfaces of the housing adjacent the lobe. In other examples, the retaining structures are grooves of the housing that receive edges of the slider. In either of these examples, as the slider is moved relative to the housing via a lever, the interaction between the slider and the housing may expand the housing during at least some of this movement and decrease the tension exerted on the carrier rails by the housing.

In other examples, instead of moving a slider relative to the housing, one or more of the carrier rails may be laterally moved relative to the housing during the process of opening and/or closing the binder apparatus. In such examples, the carrier rails and the housing may include structures that are configured to be in-sync with one another when the carrier rails are in either the open or closed position and to be out-of-sync with one another at least part of the time as the carrier rails are moving between the open and closed positions.

Figure 2:
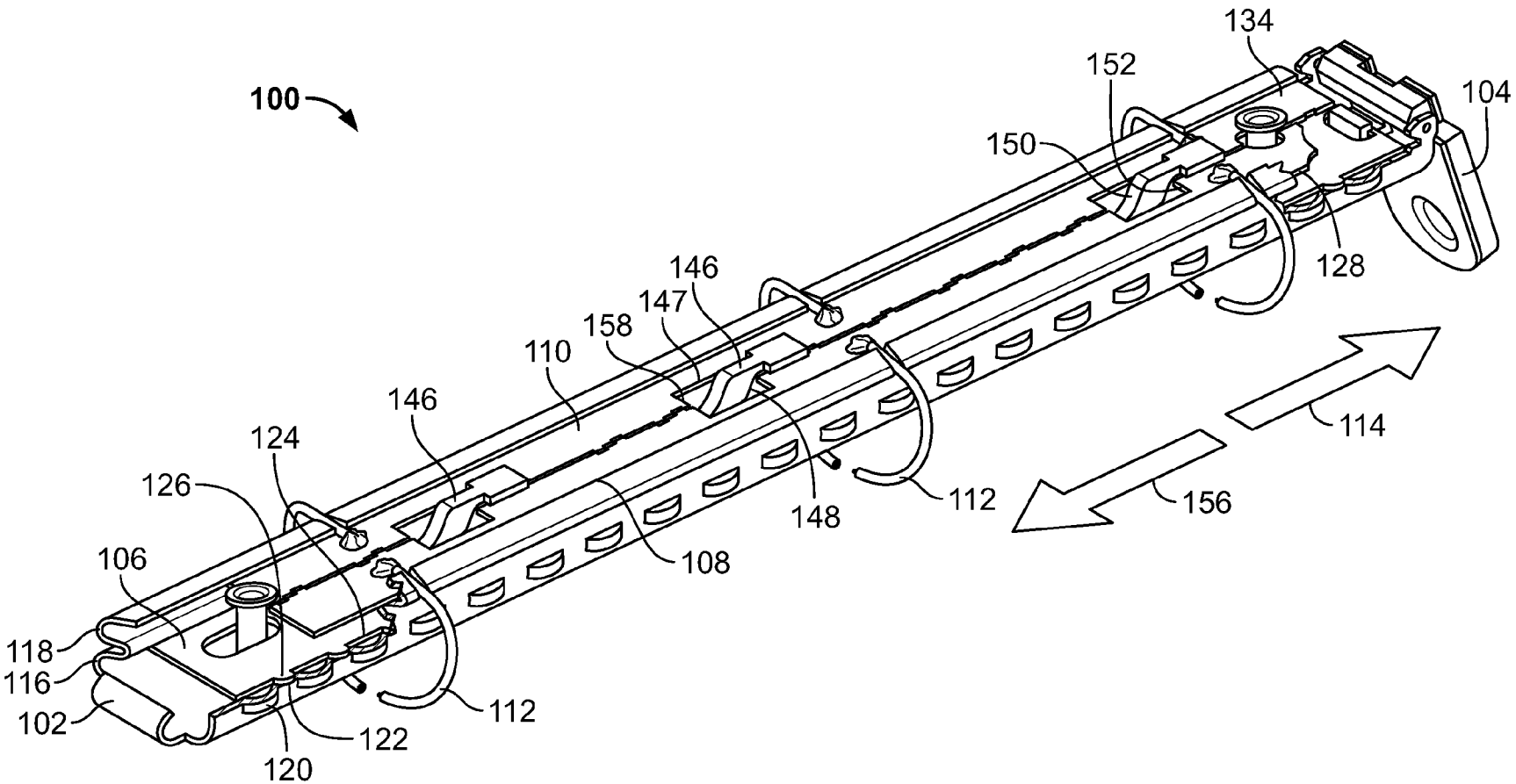
Figure 3:
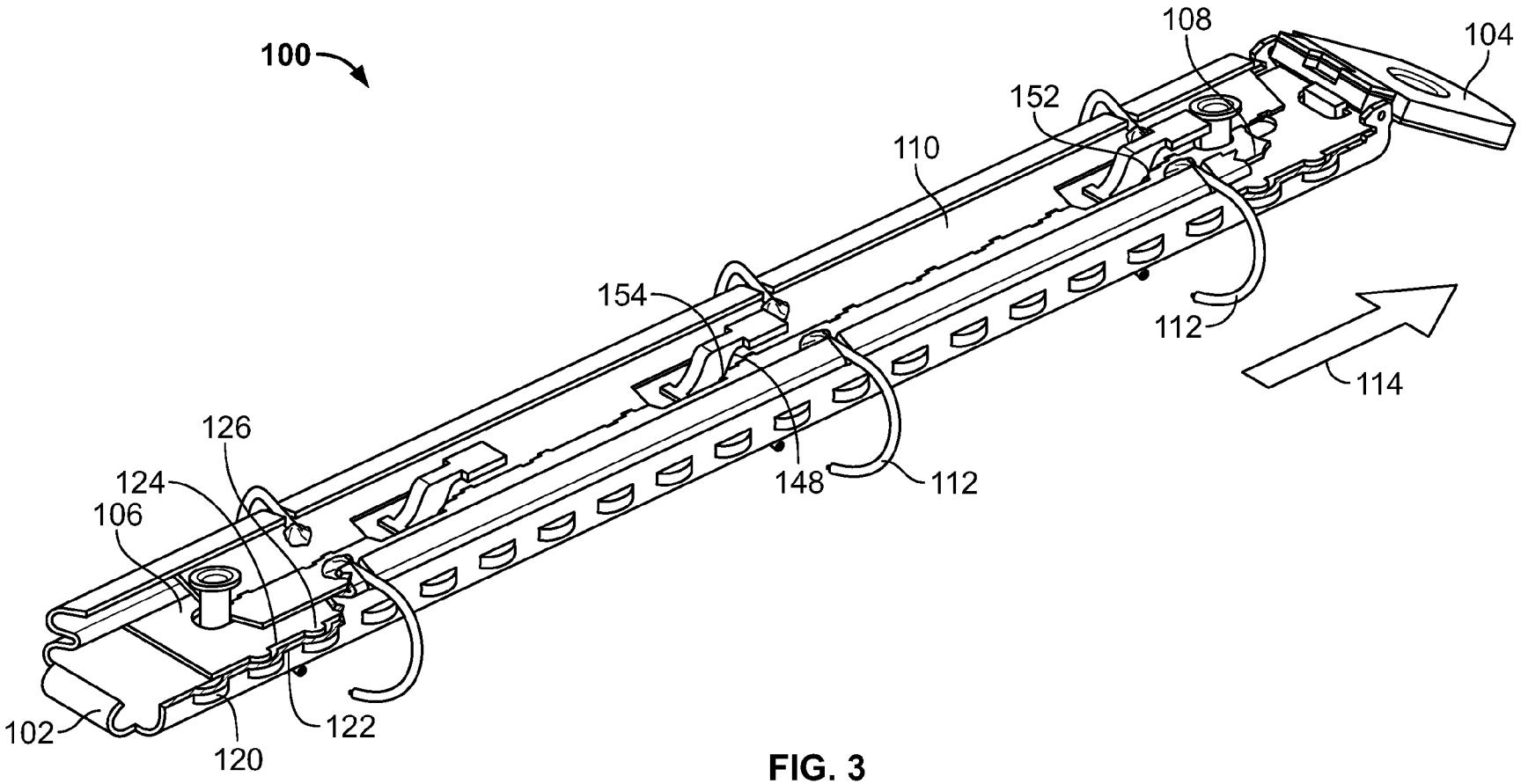

FIGS. 1-3 depict different positions of an example binder apparatus 100 that may be used to store loose leaf pages, documents, other materials, etc. The binder 100 includes a housing 102, a lever or actuating assembly 104, a slider 106 and first and second carrier rails 108 and 110. A plurality of associated closure members 112 are respectively coupled to the carrier rails 108 and 110 and, in the closed position, engage to form a closure such as a circular closure, a D-shaped closure etc. enabling materials to be stored therein.

The associated closure members 112 may be opened and/or closed by actuating the lever assembly 104. For example, to open the associated closure members 112, the lever assembly 104 may be moved in a direction generally indicated by arrow 114. In contrast, to close the associated closure members 112, the lever assembly 104 may be moved in a direction generally opposite that of arrow 114. However, in other examples, the lever assembly 104 may be moved in different directions to open and/or close the associated closure members 112.

The housing 102 may include a first lobe or opposing longitudinal grooves 116 and a second lobe or opposing longitudinal grooves 118. In this example, the first lobe 116 includes a plurality of first recesses 120 and a plurality of first protrusions 122. In other examples, instead of including the plurality of first recesses 120, the first lobe 116 may additionally or alternatively include apertures or openings.

The slider 106 may be positioned at least partially within the first lobe 116 and includes a plurality of second recesses 124 and a plurality of second protrusions 126. The plurality of second recesses 124 may receive respective ones of the plurality of first protrusions 122 when the associated closure members 112 are positioned in either the open or closed position. The plurality of second protrusions 126 receive respective ones of the plurality of first recesses 120 when the associated closure members 112 are positioned in either the open or closed position. However, when the slider 106 is positioned between the open and closed positions, the first recesses and protrusions 120 and 122 are out of alignment with the second recesses and protrusions 124 and 126. More specifically, when the slider 106 is positioned between the open and closed positions, the protrusions 122 and 126 engage to effectively expand at least portions of the housing 102. In some examples, the distances between any of the recesses of the first recesses 120, the protrusions of the first protrusions 122, the recesses of the second recesses 124 and/or the protrusions of the second protrusions 126 may correspond to an amount of travel to move the carrier rails 108 and 110 from the open position to the closed position and/or from the closed position to the open position.

The first and second carrier rails 108 and 110 are at least partially positioned within the second lobe 118. The first carrier rail 108 includes a first longitudinal edge 128 biased by the housing 102 at least when the housing 102 is in a relaxed position and a second longitudinal edge 130 including a plurality of notches 132. The second carrier rail 110 includes a third longitudinal edge 134 biased by the housing 102 at least when the housing 102 is in the relaxed position and a fourth longitudinal edge 136 including a plurality of notches 138. In some examples, only one of the first and/or second carrier rails 108 and 110 may be provided with the notches 132 and 138. The second longitudinal edge 130 may be hingably coupled to the fourth longitudinal edge 136 via a plurality of corresponding tabs and/or notches 140, for example.

The slider 106 includes an aperture or other structure 142 to couple an arm 144 of the lever assembly 104 thereto. In this example, the slider 106 includes a plurality of control elements 146 extending therefrom and at least partially through openings 147 defined by the notches 132 and 138. While the example slider 106 includes three control elements 146, the example slider 106 may include any other number (e.g., 1, 2, 3, 4, etc.) of control elements 146 that may be evenly or unevenly spaced along the slider 106, for example.

The plurality of control elements 146 interact with the carrier rails 108 and 110 to move, urge, transition and/or secure the carrier rails 108 and 110 in a first or open position and/or a second or closed position. In some examples, the plurality of control elements 146 extend substantially perpendicularly from the slider 106. In some examples, one of the plurality of control elements 146 is positioned adjacent to each of the associated closure members 112.

Each of the plurality of control elements 146 may include a first control surface 148 and a second control surface 150 opposite the first control surface 148. Depending on the position of the control elements 146 relative to the carrier rails 108 and 110, the first and second control surfaces 148 and 150 may move, urge, transition and/or secure the carrier rails 108 and 110 in and/or toward a particular position.

Prior to moving the carrier rails 108 and 110 from, for example, the closed position depicted in FIG. 1 to the open position depicted in FIG. 3, the closure members 112 and the carrier rails 108 and 110 are positioned in the closed position and the recesses and protrusions 120-126 are respectively in-sync with one another. When the recesses and protrusions 120-126 are in-sync, the housing 102 is in a relatively relaxed state.

However, as the lever assembly 104 is moved in a direction generally represented by arrow 114 and depicted in FIG. 2, the slider 106 and the plurality of control elements 146 are also moved in the direction generally represented by arrow 114. As such, the protrusions 122 and 126 of the housing 102 and the slider 106 engage and expand the first lobe 116 of the housing 102 which in turn expands the second lobe 118 of the housing 102. Expanding the second lobe 118 decreases an amount of force and/or tension exerted on the respective longitudinal edges 128 and 134 of the carrier rails 108 and 110. Thus, the housing 102 may be expanded prior to and/or while the first control surface 148 engages respective surfaces and/or edges 152 of the carrier rails 108 and 110 adjacent to and/or defining the openings 147. The interaction between the surfaces 148 and 152 moves and/or transitions the carrier rails 108 and 110 and, thus, the associated closure members 112 to the open position as the slider 106 and the control elements 146 are being moved relative thereto. Expanding the housing 102 enables the housing 102 to exert less tension on the carrier rails 108 and 110 and for the carrier rails 108 and 110 to be more easily moved between the open and closed positions.

As the lever assembly 104 is further moved in a direction generally represented by arrow 114 and depicted in FIG. 3, the closure members 112 are in the open position and the recesses and protrusions 120-126 are once again respectively in-sync with one another enabling the housing 102 to be in the relaxed state. In this example, when the slider 106 is in the open position, the second recesses and protrusions 124 and 126 are shifted as compared to when the slider 106 is in the closed position such that the second recesses 124 receive a different one of the first protrusions 122 and the second protrusions 126 are received by a different one of the first recesses 120.

In some examples, the first control surface 148 includes a notch, step or different curvature 154 to be positioned adjacent the respective surfaces 152 when the associated closure members 112 are fully open. The interaction between the step 154 and the respective surfaces 152 may secure the carrier rails 108 and 110 and the associated closure members 112 in the open position. Additionally or alternatively, the housing 102 being in the relaxed state when the closure members 112 are in the open position enables the housing 102 to exert substantial tension on the carrier rails 108 and 110 to secure the carrier rails 108 and 110 and the associated closure members 112 in the open position.

As the lever assembly 104 is moved in the direction generally represented by arrow 156 and depicted in FIG. 2, the slider 106 and the plurality of control elements 146 are also moved in a direction generally represented by arrow 156. As such and as discussed above, the protrusions 122 and 126 of the housing 102 and the slider 106 engage and expand the first lobe 116 of the housing 102 which in turn expands the second lobe 118 of the housing 102. Thus, the housing 102 may be expanded prior to and/or while the second control surface 150 engages respective surfaces and/or edges 158 of the carrier rails 108 and 110 adjacent to and/or defining the openings 147. The interaction between the surfaces 150 and 158 moves and/or transitions the carrier rails 108 and 110 and, thus, the associated closure members 112 to the closed position as the slider 106 and the control elements 146 are being moved relative thereto. In some examples, the second control surface 150 includes a curved and/or sloped surface that transitions the carrier rails 108 and 110 from the open position to the closed position as the slider 106 is being moved from the first position to the second position.

As the lever assembly 104 is further moved in a direction generally represented by arrow 156 and depicted in FIG. 1, the closure members 112 are in the closed position and the recesses and the protrusions 120-126 are once again respectively in-sync with one another enabling the housing 102 to be in the relaxed state. In this example, when the slider 106 is in the closed position, the second recesses and protrusions 124 and 126 are shifted as to compared to when the slider 106 is in the open position such that the second recesses 124 receive a different one of the first protrusions 122 and the second protrusions 126 are received by a different one of the first recesses 120.

In some examples, in the closed position, the control elements 146 are substantially positioned between the carrier rails 108 and 110 and the housing 102, thereby securing the carrier rails 108 and 110 and the associated closure members 112 in the closed position. Additionally or alternatively, the housing 102 being in the relaxed state when the closure members 112 are in the closed position enables the housing 102 to exert substantial tension on the carrier rails 108 and 110 to secure the carrier rails 108 and 110 and the associated closure members 112 in the closed position.

In some examples, in the closed position, an extension 160 of the control elements 146 at least partially extends over the respective surfaces 152 to substantially ensure alignment of the control elements 146 with the carrier rails 108 and 110 when the control elements 146 are moved relative thereto. For example, the extension 160 extending over the respective surfaces 152 substantially ensures that the control elements 146 do not bind on the carrier rails 108 and/or 110 as the control elements 146 are moved from the second position to the first position.

The housing 102 may include one or more posts 162 extending from an interior surface 164 of the housing 102. In some examples the slider 106 defines one or more slots 166 through which the posts 162 extend. Interaction between the slots 166 and the posts 162 at least partially guides the movement of the slider 106 as the lever assembly 104 moves the slider 106 between open and closed positions.

Figure 4:
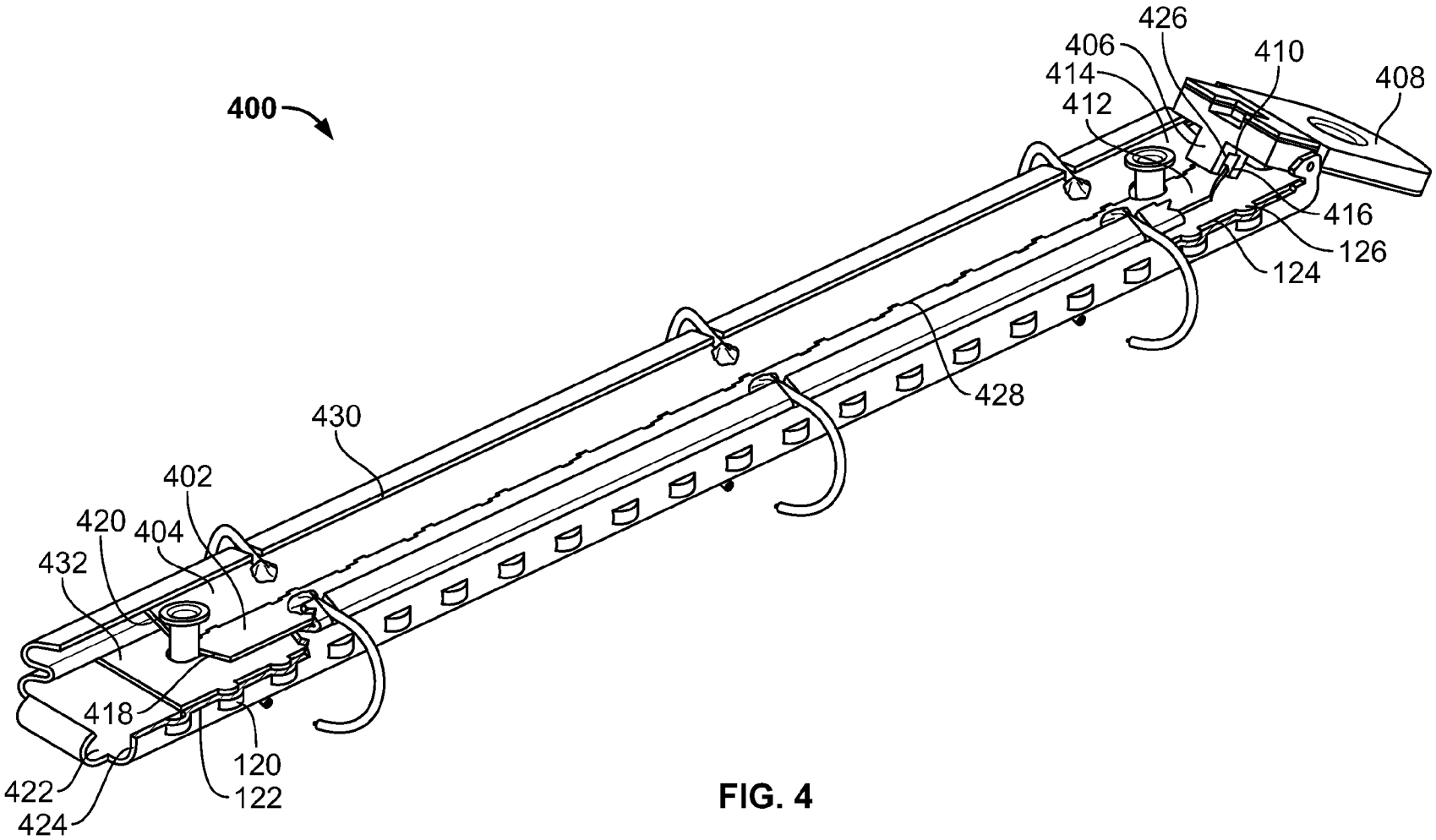
FIG. 4 depicts another example binder apparatus.

FIG. 4 depicts an example binder apparatus 400 that is similar to the example binder 100. However, in contrast to the example binder 100, the example binder 400 includes carrier rails 402 and 404 that are moved and/or transitioned by a portion or beak 406 of an example lever assembly 408 instead of being moved and/or transitioned by the control elements 146. More specifically, the beak 406 includes a groove 410 that receives ends 412 and/or 414 of the carrier rails 402 and 404. To move and/or transition the carrier rails 402 and 404 from, for example, an open position to a closed position, a first surface 416 of the beak 406 engages a lower surface 418 and 420 of the carrier rails 402 and 404 facing an inner surface 422 of a housing 424. To move and/or transition the carrier rails 402 and 404 from, for example, the closed position to an open position, a second surface 426 of the beak 406 engages surfaces 428 and 430 of the carrier rails 402 and 404. As described above, the housing 424 includes the plurality of first recesses 120 and the plurality of first protrusions 122 and a slider 432 includes the plurality of second recesses 124 and the plurality of second protrusions 126. As such, as the slider 432 is being moved from the open position to the closed position or from the closed position to the open position, the protrusions 122 and 126 engage to effectively expand at least portions of the housing 424.

Figure 5:
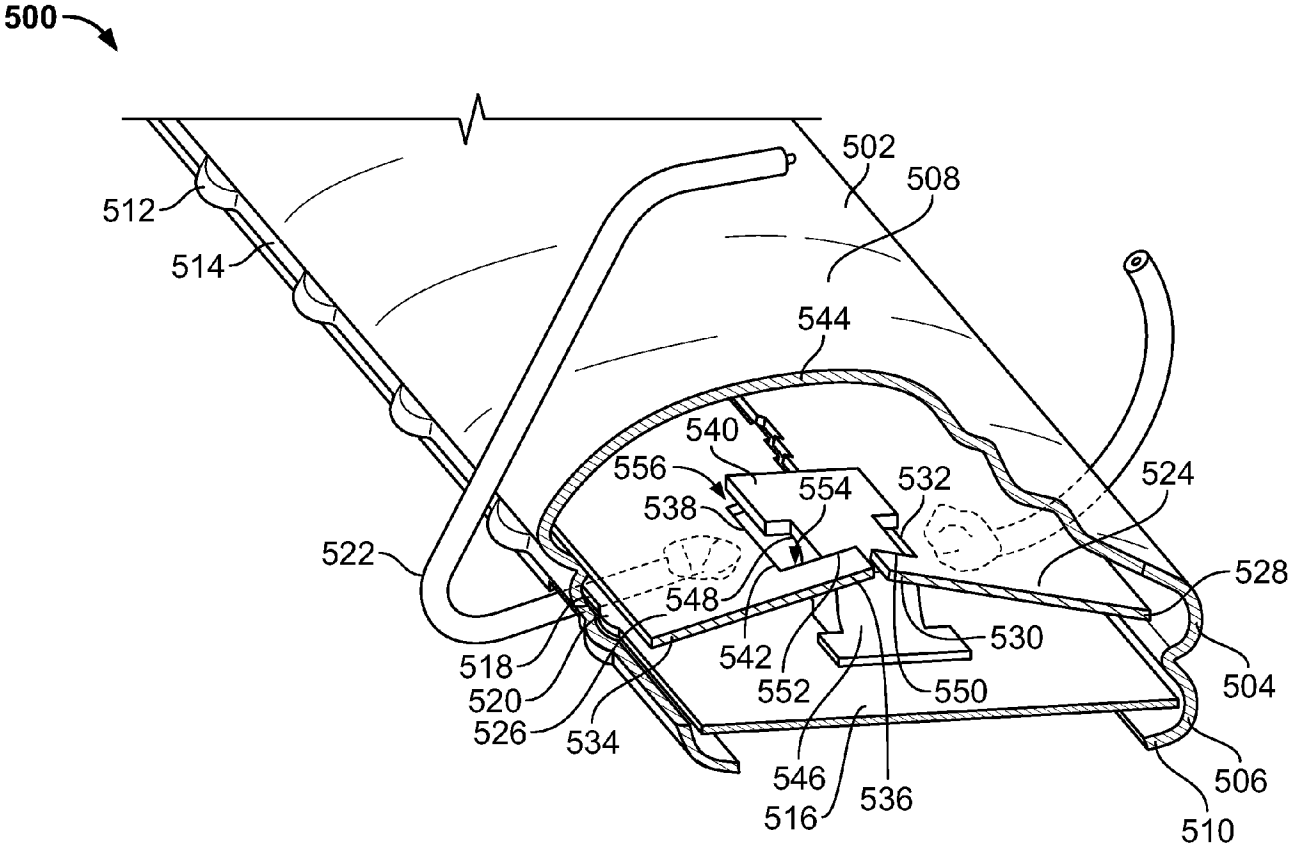
FIG. 5 depicts another example binder apparatus.

FIG. 5 depicts a portion of another example binder apparatus 500. As with the example binder 100 described above, the example binder 500 includes a housing 502 having a first lobe or opposing longitudinal grooves 504 and a second lobe or opposing longitudinal grooves 506. In contrast to the examples described above, the first lobe 504 is adjacent a top 508 of the housing 502 as opposed to being adjacent a bottom 510 of the housing 502. Additionally, in contrast to the examples described above, the second lobe 506 is adjacent the bottom 510 of the housing 502 as opposed to being adjacent the top 508 of the house 502.

In this example, the second lobe 506 includes a plurality of first recesses 512 and a plurality of first protrusions 514. In other examples, instead of including the plurality of first recesses 512, the second lobe 506 may additionally or alternatively include apertures or openings. A slider 516 may be positioned at least partially within the second lobe 506 and includes a plurality of second recesses 518 and second protrusions 520. The plurality of second recesses 518 receive respective ones of the plurality of first protrusions 514 when associated closure members 522 are positioned in either the open or closed position. The plurality of second protrusions 520 are received by respective ones of the first recesses 512 when the associated closure members 522 are positioned in either the open or closed position. However, as discussed above, when the slider 516 is positioned between the open and closed positions, the first recesses and protrusions 512 and 514 are out of alignment with the second recesses and protrusions 518 and 520. Thus, when the slider 516 is positioned between the open and closed positions, the protrusions 514 and 520 engage to effectively expand at least portions of the housing 502.

First and second carrier rails 524 and 526 are at least partially positioned within the first lobe 504. The first carrier rail 524 includes a first longitudinal edge 528 biased by the housing 502 at least when the housing 502 is in a relaxed position and a second longitudinal edge 530 including a plurality of notches 532. The second carrier rail 526 includes a third longitudinal edge 534 biased by the housing 502 at least when the housing 502 is in the relaxed position and a fourth longitudinal edge 536 including a plurality of notches 538.

In this example, the slider 516 includes a plurality of control elements 540 extending therefrom and at least partially through openings 542 defined by the notches 532 and 538. In contrast to the example described above, the control elements 540 extend toward an interior surface 544 of the housing 502. The example binder 500 may include any number of control elements (e.g., 1, 2, 3, 4, etc.) that may be evenly or unevenly spaced along the slider 516.

The control elements 540 include a first control surface 546 and a second control surface 548 that move, urge, transition and/or secure the carrier rails 524 and 526 toward and/or in the open or closed position. In some examples, the first control surface 546 is to engage respective surfaces and/or edges 550 and/or 552 of the carrier rails 524 and 526 to secure the associated closure members 522 in the open position when the slider 516 is in the first position. The respective surfaces 550 and 552 may face away from the interior surface 544 of the housing 502. In some examples, the second control surface 548 defines a step 554 to be positioned over respective surfaces and/or edges 556 of the carrier rails 524 and 526 in the closed position when the slider 516 is in the second position. The respective surfaces 556 may face toward the interior surface 544 of the housing 502. Additionally or alternatively, the housing 502 being in the relaxed state when the closure members 522 are in the open position, enables the housing 502 to exert substantial tension on the carrier rails 524 and 526 to secure the carrier rails 524 and 526 and the associated closure members 522 in the open position.

Figure 6:
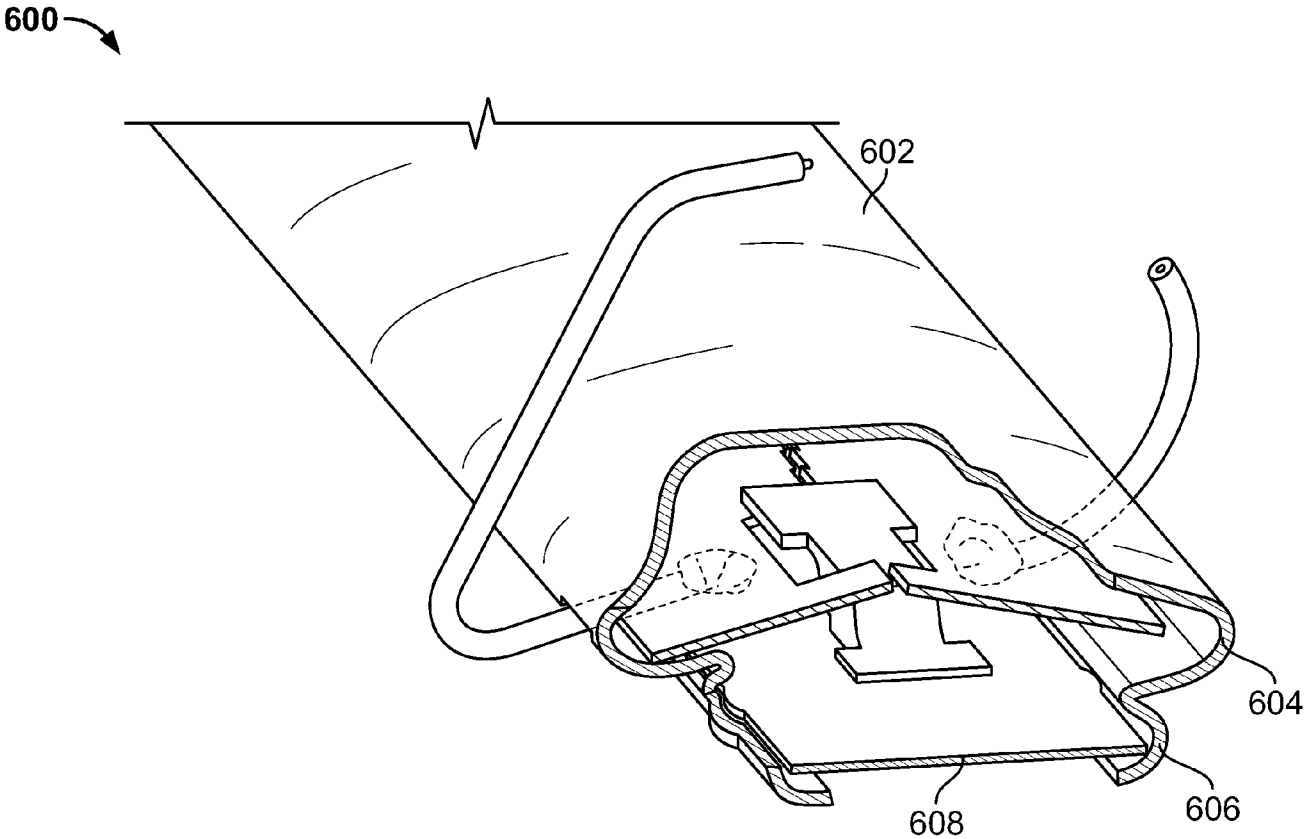
FIG. 6 depicts another example binder apparatus.

FIG. 6 depicts a portion of another example binder apparatus 600 that is similar to the example binder 500 described above. However, in contrast to the example binder 500, the example binder 600 includes a housing 602 having a first lobe or opposing longitudinal grooves 604 and a second lobe or opposing longitudinal grooves 606 having a different size and/or shape than the first lobe 604. Thus, a slider 608 at least partially positioned within the second lobe 606 may be differently sized (e.g., have a different width) than the slider 516.

Figure 7:
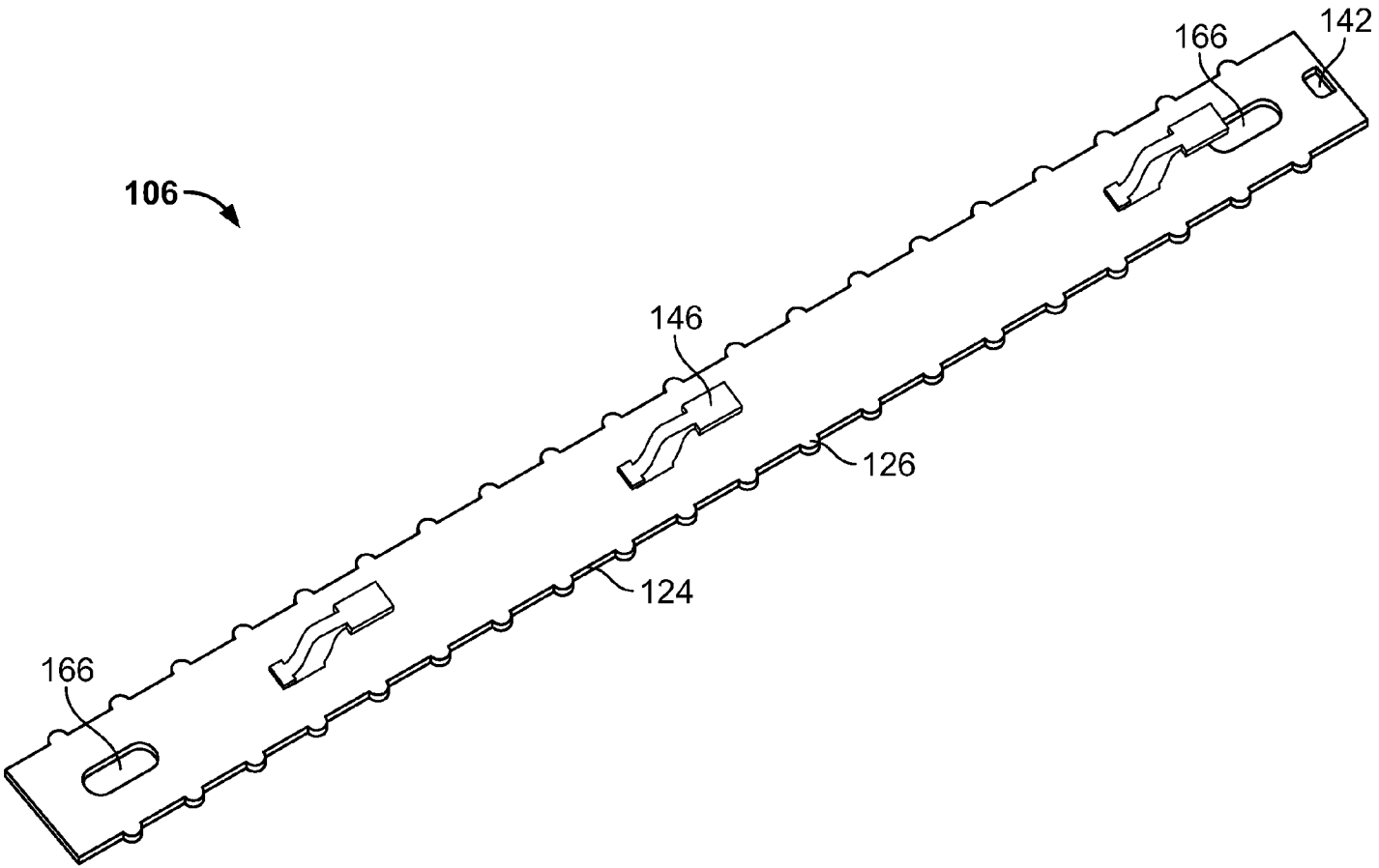
FIGS. 7 and 8 depict different example sliders that can be used to implement the examples described herein.

FIG. 7 depicts the example slider 106 that may be used to implement the examples described herein. The example slider 106 includes the plurality of second recesses 124 and the plurality of second protrusions 126 that interact with the structures of, for example, the housing 102 to control tension exerted on the carrier rails 108 and 110. The example slider 106 additionally includes the slots 166 that interact with the posts 162 to at least partially guide the movement of the slider 106 as the slider 106 is being moved between the open and closed positions. The slider 106 also includes the control elements 146 that interact with, for example, the carrier rails 108 and 110 to move the carrier rails 108 and 110 between the open and closed positions. The slider 106 also includes the aperture 142 that enables the slider 106 to be operably coupled to the lever assembly 104.

Figure 8:
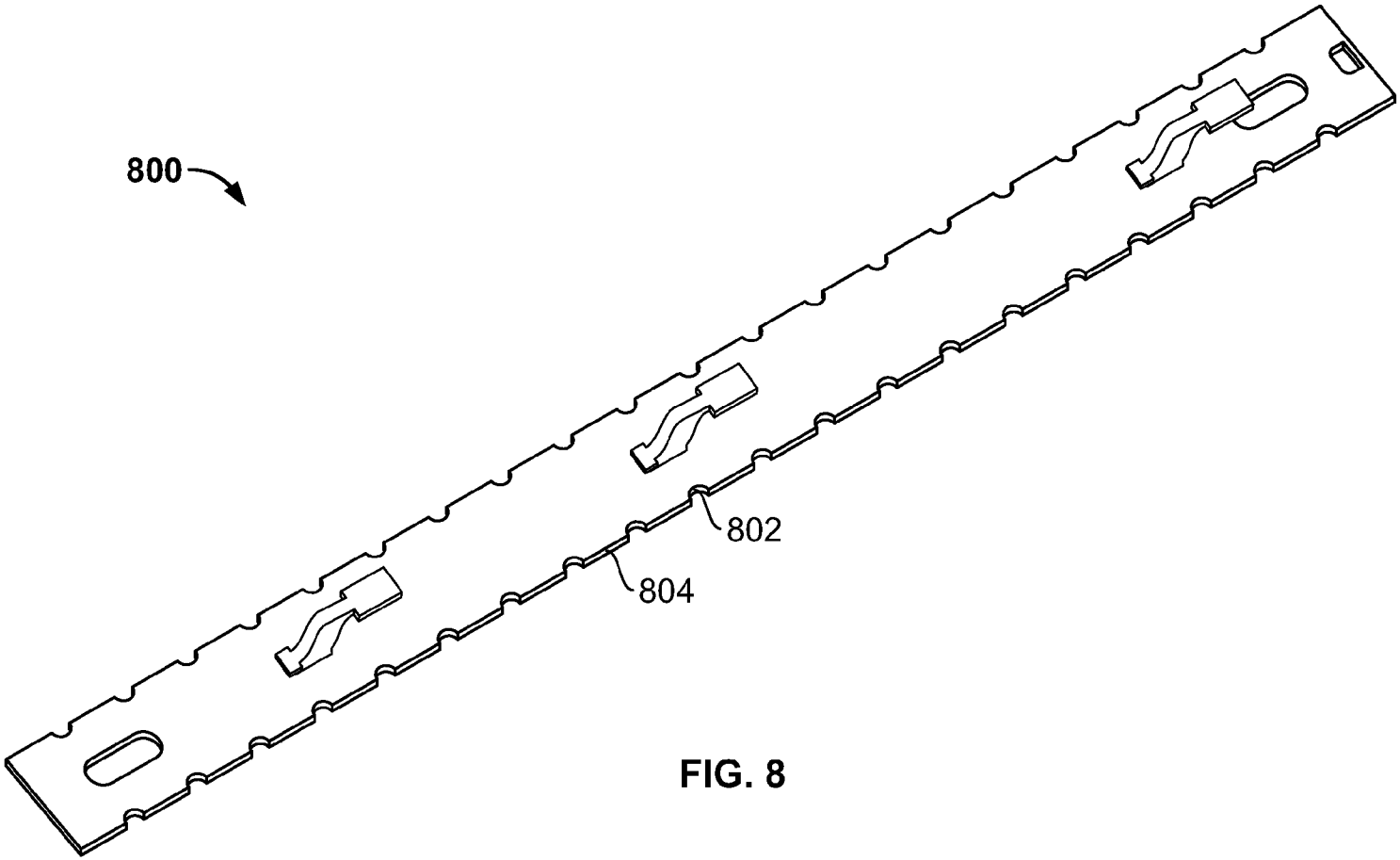

FIG. 8 depicts an alternative example slider 800 that includes a plurality of example recesses 802 and a plurality of example protrusions 804. As the plurality of recesses 802 and protrusions 804 are different than the plurality of second protrusions 126 and recesses 124, an example housing of a binder apparatus used in connection with the slider 800 may include structures (e.g., protrusions, recesses, etc.) that correspond to the plurality of recesses 802 and protrusions 804 to enable the position of the slider 800 to control the tension exerted by the housing on carrier rails positioned at least partially within the housing.

Figure 9:
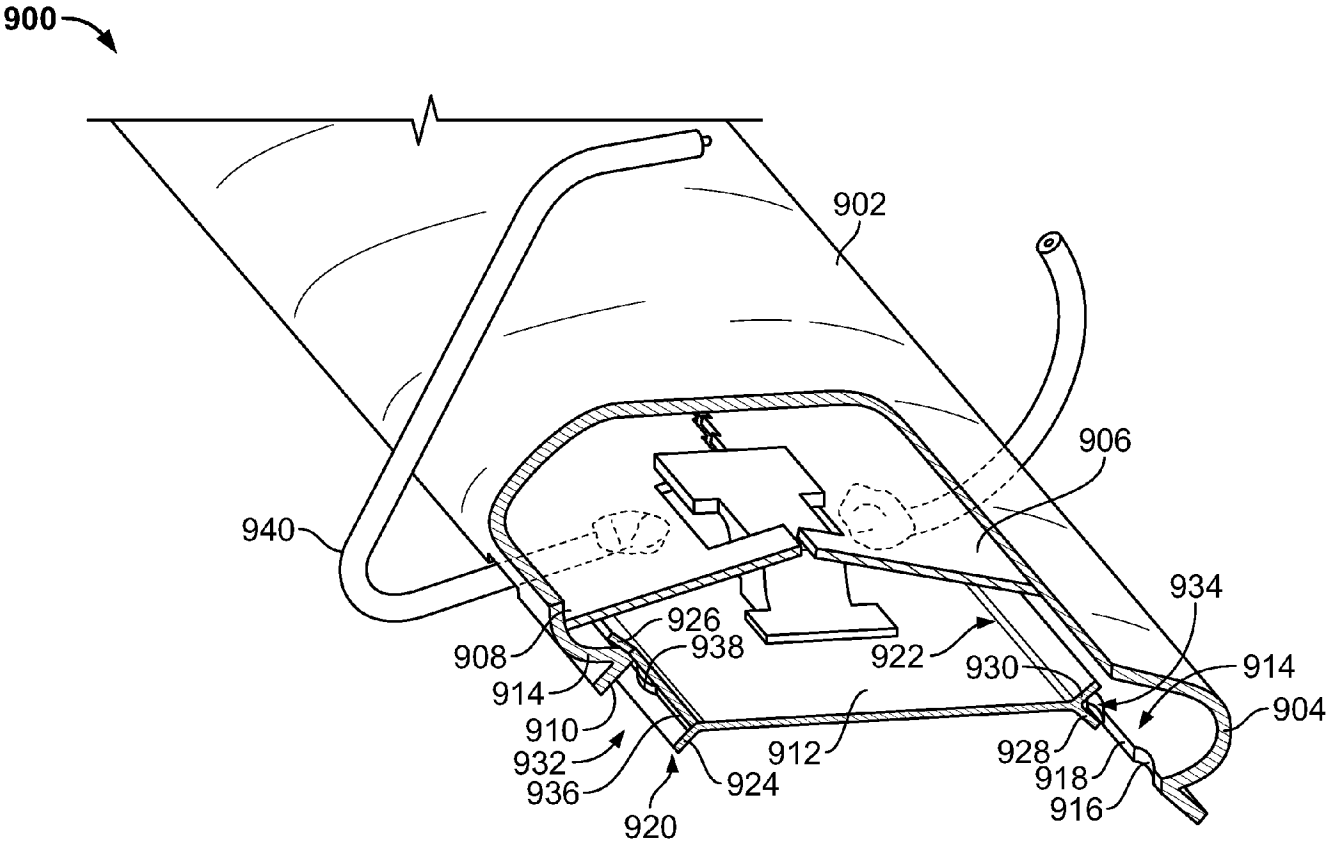
FIG. 9 depicts another example binder apparatus.

FIG. 9 depicts a portion of another example binder apparatus 900. In contrast to the examples described above, the example binder 900 includes a housing 902 having lobe or opposing longitudinal grooves 904 into which first and second carrier rails and 906 and 908 are at least partially positioned. In some examples, the housing 902 additionally includes a spacer or tapered portion 910 that may extend from the lobe 904. The spacer 910 may enable a slider 912 coupled to the housing 902 to be easily movable relative to the housing 902 once, for example, the binder 900 is secured within a binder.

A portion 914 of the housing 902 between the lobe 904 and the spacer 910 may include a plurality of first recesses 916 and a plurality of first protrusions 918. To couple the slider 912 to the housing 902, sides 920 and 922 of the slider 912 may include a plurality of tapered portions 924-930 defining opposing grooves 932 and 934 that receive the respective portions 914 of the housing 902. Positioned between the tapered portions 924 and 926 and between the tapered portions 928 and 930, the slider 912 includes a plurality of second recesses 936 and a plurality of second protrusions 938.

Similar to the examples discussed above, the plurality of second recesses 936 receive respective ones of the plurality of first protrusions 918 when the associated closure members 940 are positioned in either the open or closed position. The plurality of second protrusions 938 are received by respective ones of the first recesses 916 when the associated closure members 940 are positioned in either the open or closed position. However, when the slider 912 is positioned between the open and closed positions, the first recesses 916 and protrusions 918 are out of alignment with the second recesses 936 and protrusions 938. Thus, when the slider 912 is positioned between the open and closed positions, the protrusions 918 and 98 engage to effectively expand at least portions of the housing 902.

Figure 10:
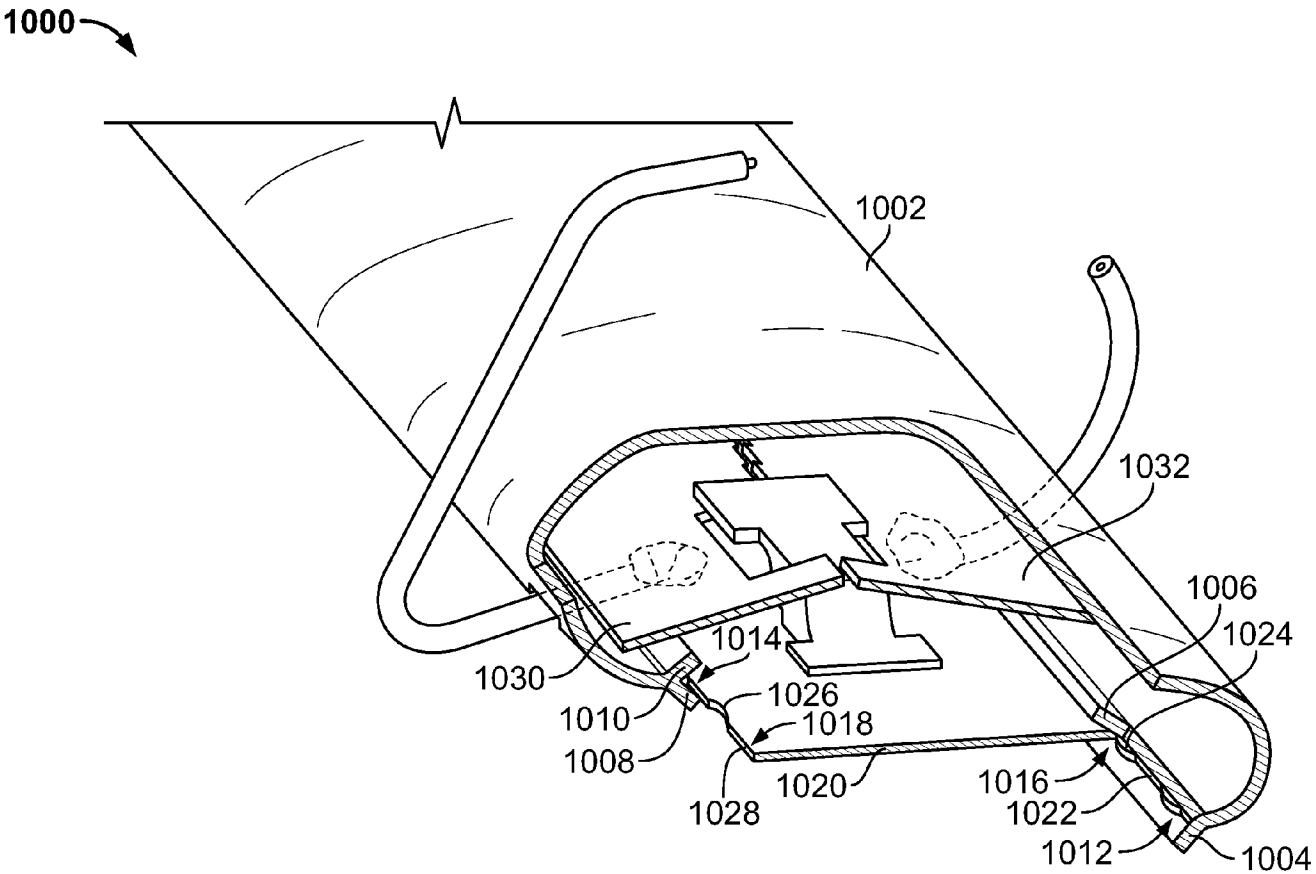
FIG. 10 depicts another example binder apparatus.

FIG. 10 depicts a portion of another example binder apparatus 1000 that is similar to the example binder 900. However, in contrast, a housing 1002 includes a plurality of tapered portions 1004-1010 defining opposing grooves 1012 and 1014 that receive sides 1016 and 1018 of a slider 1020 movably coupled thereto. Positioned between the tapered portions 1004 and 1006 and between the tapered portions 1008 and 1010, the housing 1002 includes a plurality of recesses 1022 and a plurality of protrusions 1024. The slider 1020 includes a plurality of recesses 1026 and a plurality of protrusions 1028 positioned along the sides 1016 and 1018. As the slider 1020 is moved relative to the housing 1002, the interaction between the plurality of protrusions 1024 and 1028 expands the housing 1002 enabling the carrier rails 1030 and 1032 to relatively easily transition between the open or closed position.

Figure 11:
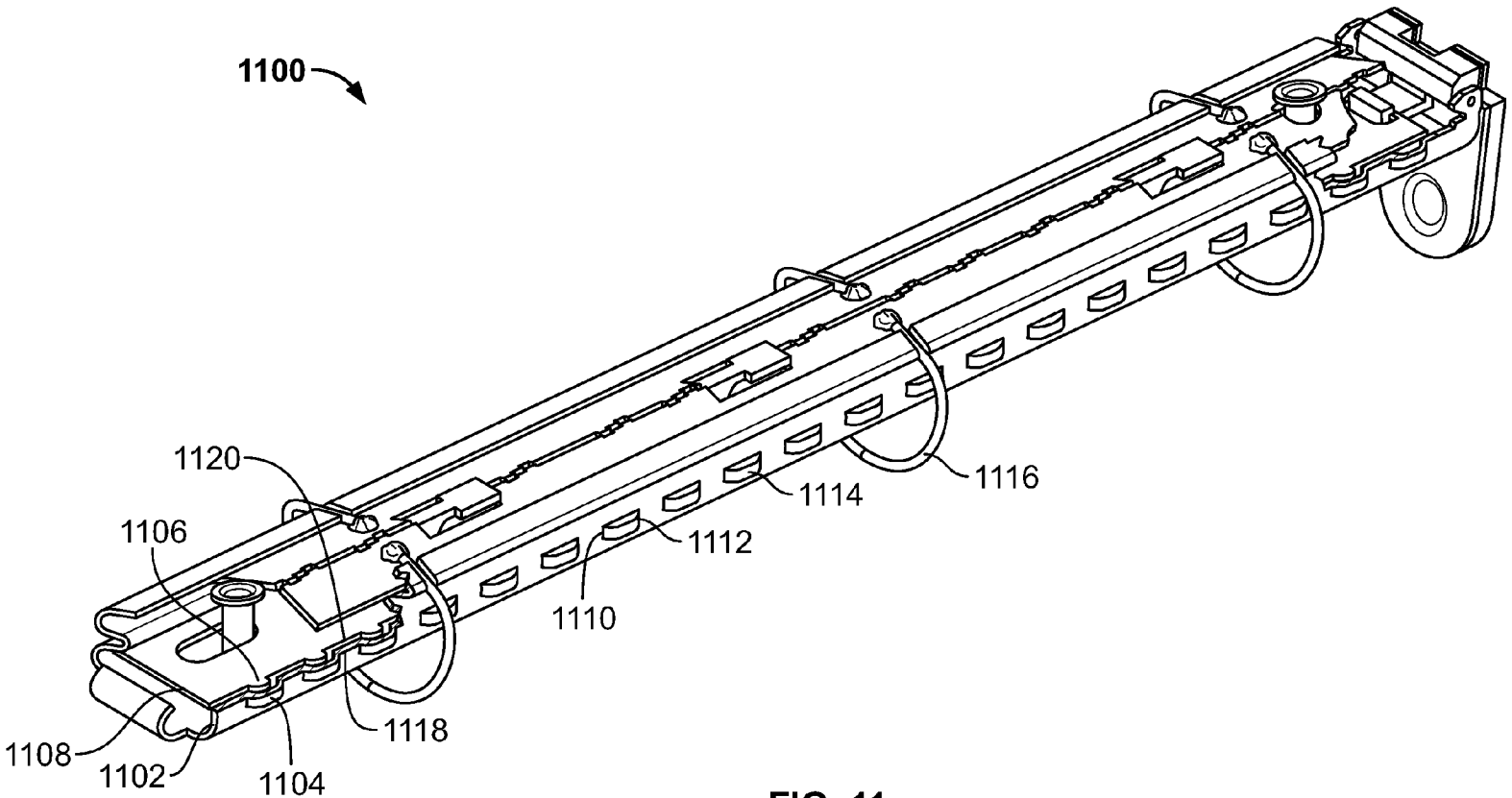
FIG. 11 depicts another example binder apparatus.

FIG. 11 depicts an example binder apparatus 1100 that is similar to the example binder 100 described above. However, in contrast, the example binder 1100 includes a housing 1102 having a plurality of first recesses 1104 that are differently sized and/or shaped than a plurality of second protrusions 1106 of an example slider 1108. More specifically, the plurality of first recesses 1104 may include tapered surfaces 1110 and 1112 and a flat surface 1114. Thus, when the slider 1108 is moved to either open or close associated closure members 1116, the slider 1108 may move relative to the housing 1102 without the housing 1102 being expanded.

In some examples, the plurality of first recesses 1104 and a plurality of first protrusions 1118 of the housing 1102 and the plurality of second protrusions 1106 and a plurality of second recesses 1120 may be configured such that as the slider 1108 is moved to the open position from the closed position, for example, the second protrusions 1106 may initially move along the flat surface 1114 prior to the protrusions 1106 and 1118 engaging and expanding the housing 1102. In other examples, the plurality of recesses 1104 and 1120 and the plurality of protrusions 1106 and 1118 may be configured such that as the slider 1108 is moved to the open position from the closed position, for example, the second protrusions 1106 may substantially immediately move from being adjacent the tapered surface 1112 to the protrusions 1106 and 1118 engaging and expanding the housing 1102. Thereafter and prior to the closure members 1116 being in the open position, the second protrusions 1106 may be received by another one of the first recesses 1104 enabling the housing 1102 to return to the relaxed position.

Figure 12:
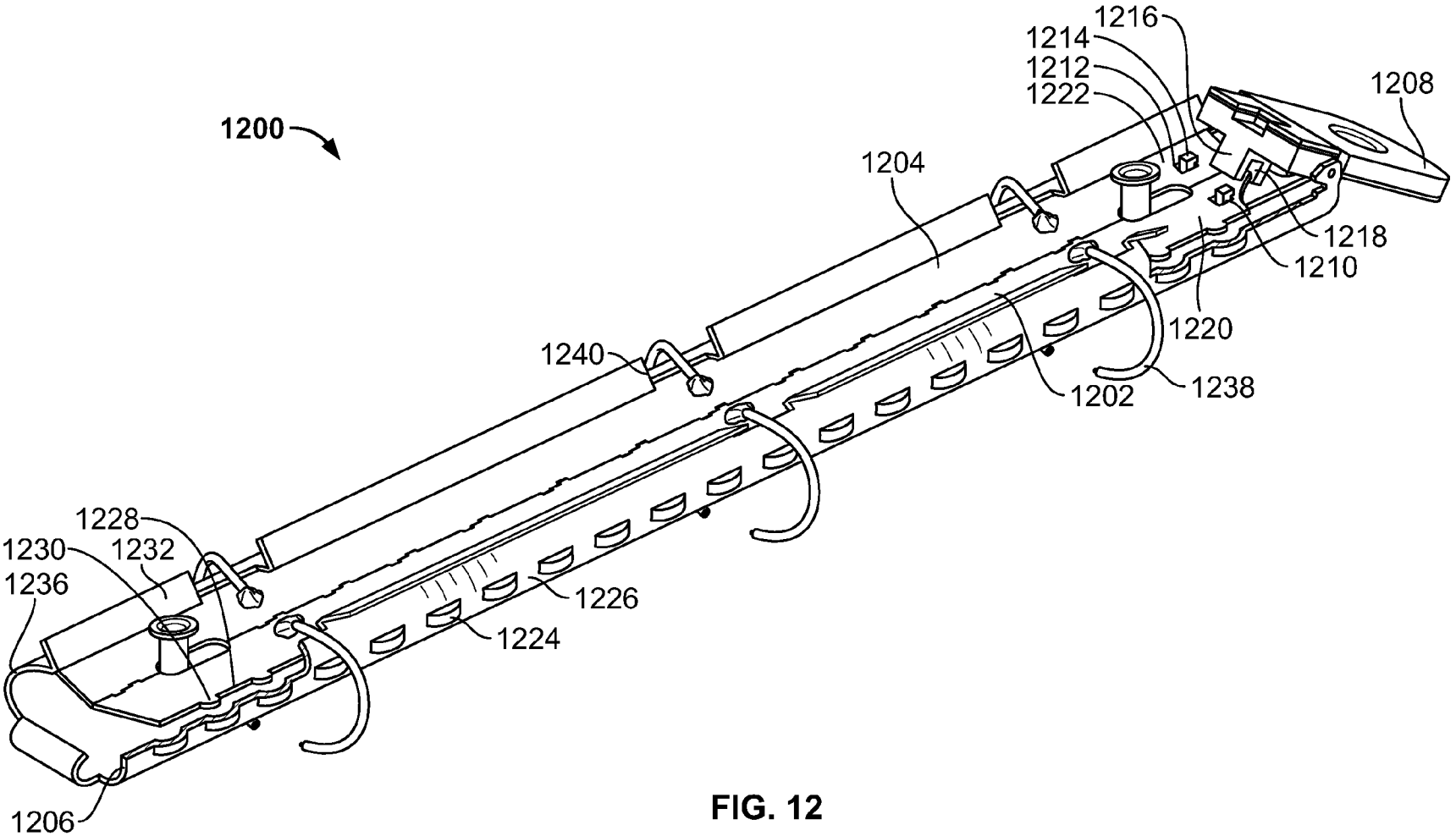
FIG. 12 depicts another example binder apparatus.

FIG. 12 depicts an example binder apparatus 1200 having carrier rails 1202 and 1204 including structures (e.g., recesses, protrusions) that correspond to structures (e.g., recesses, protrusions) of a housing 1206. Thus, in contrast to the examples described above, as the carrier rails 1202 and 1204 are being moved by a lever assembly 1208 between the open and closed positions, the carrier rails 1202 and/or 1204 may also be longitudinally moved by the lever assembly 1208 relative to the housing 1206.

To enable the carrier rails 1202 and/or 1204 to be longitudinally moved relative to the housing 1206, the carrier rails 1202 and 1204 may include apertures or other structure 1210 and 1212 to couple respective arms 1214 of the lever assembly 1208 thereto. Similar to the example binder 400 described above, to move and/or transition the carrier rails 1202 and 1204 between the open and/or closed positions, the lever assembly 1208 may include a portion or beak 1216 having a groove 1218 that receives ends 1220 and 1222 of the carrier rails 402.

In this example, the housing 1206 includes a plurality of first recesses 1224 and a plurality of first protrusions 1226 and one or more of the carrier rails 1202 and 1204 may include a plurality of second recesses 1228 and a plurality of second protrusions 1230. As the carrier rails 1202 and 1204 are moved relative to the housing 1206 between, for example, an open and closed position, the carrier rails 1202 and 1204 are longitudinally moved such that the protrusions 1226 and 1230 engage expanding the housing 1206. Also, as the carrier rails 1202 and 1204 are moved relative to the housing 1206 between the open and closed position, the carrier rails 1202 and 1204 are moved by the beak 1216 toward the closed position. Once the binder 1200 is positioned in the closed position, the second recesses and protrusions 1228 and 1230 are shifted as compared to when the carrier rails 1202 and 1204 are in the open position such that the second recesses 1228 receive a different one of the first protrusions 1226 and the second protrusions 1230 are received by a different one of the first recesses 1224.

In some examples, the housing 1206 additionally includes a spacer or tapered portion 1232 that may extend from a lobe 1236 of the housing 1206. The tapered portion 1232 may enable associated closure members 1238 to be easily movable relative to the housing 1206 within openings or slots 1240 once, for example, the binder 1200 is secured within a binder.

Furthermore, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A binder apparatus, comprising:

a housing comprising a plurality of housing structures;

a first carrier rail having a first longitudinal edge and a second longitudinal edge, the housing engaging the first longitudinal edge;

a second carrier rail having a third longitudinal edge and a fourth longitudinal edge, the housing engaging the third longitudinal edge, the second longitudinal edge hingably engaging the fourth longitudinal edge;

a slider comprising a plurality of slider structures to interact with at least some of the housing structures; and a lever operatively coupled to the slider to move the slider between a first position and a second position, in the first position, a first slider structure of the plurality of slider structures engages a first housing structure of the plurality of housing structures and the first and second carrier rails are in a closed position, in the second position, the first slider structure engages a second housing structure of the plurality of housing structures and the first and second carrier rails are in an open position.

2. The binder apparatus of claim 1, wherein the lever is to further move the slider to a third position between the first position and the second position, in the third position, the first slider structure engages a surface between the first housing structure and the second housing structure to expand the housing to enable the first and second carrier rails to more easily move between the closed position and the open position.

3. The binder apparatus of claim 1, wherein the plurality of housing structures comprises at least one of a plurality of recesses, a plurality of apertures, or a plurality of protrusions.

4. The binder apparatus of claim 1, wherein the plurality of slider structures comprises at least one of a plurality of protrusions, or a plurality of recesses.

5. The binder apparatus of claim 1, wherein the housing comprises first opposing longitudinal grooves in which the first longitudinal edge and the third longitudinal edge are respectively positioned.

6. The binder apparatus of claim 5, wherein the housing further comprises second opposing longitudinal grooves in which longitudinal edges of the slider are respectively positioned.

7. The binder apparatus of claim 6, wherein the first opposing longitudinal grooves comprise a first lobe and the second opposing longitudinal grooves comprise a second lobe.

8. The binder apparatus of claim 6, wherein the plurality of housing structures are at least partially positioned in the second opposing longitudinal grooves.

9. The binder apparatus of claim 6, wherein the first opposing longitudinal grooves have a different cross-section than the second opposing longitudinal grooves.

10. The binder apparatus of claim 5, wherein at least one of the housing or the slider comprise corresponding retaining structure to retain the slider relative to the housing.

11. The binder apparatus of claim 10, wherein the corresponding retaining structure comprises grooves of the slider that receive surfaces adjacent the first opposing longitudinal grooves.

12. The binder apparatus of claim 11, wherein the plurality of slider structures are positioned within the grooves and the plurality of housing structures are positioned along the surfaces.

13. The binder apparatus of claim 10, wherein the corresponding retaining structure comprises grooves adjacent the first opposing longitudinal grooves that receive edges of the slider.

14. The binder apparatus of claim 13, wherein the plurality of housing structures are positioned within the grooves and the plurality of slider structures are positioned along the edges.

15. A binder apparatus, comprising:

a housing comprising a plurality of lateral recesses or apertures;

a first carrier rail having a first longitudinal edge and a second longitudinal edge, the housing engaging the first longitudinal edge;

a second carrier rail having a third longitudinal edge and a fourth longitudinal edge, the housing engaging the third longitudinal edge, the second longitudinal edge hingably engaging the fourth longitudinal edge; and a slider comprising a plurality of protrusions to be received by at least some of the lateral recesses or apertures.

16. The binder apparatus of claim 15, further comprising a lever operatively coupled to the slider to move the slider between a first position and a second position, in the first position, a first protrusion of the plurality of protrusions is received by a first recess of the plurality of recesses and the first and second carrier rails to be in a closed position, in the second position, the first protrusion to be positioned in a second recess of the plurality of recesses and the first and second carrier rails to be in an open position.

17. The binder apparatus of claim 16, wherein the lever is to further move the slider to a third position between the first position and the second potion, in the third position, the first protrusion engages a surface between the first recess and the second recess to expand the housing to enable the first and second carrier rails to more easily move between the closed position and the open position.

18. The binder apparatus of claim 15, wherein the housing comprises first opposing longitudinal grooves in which the first longitudinal edge and the third longitudinal edge are respectively positioned.

19. The binder apparatus of claim 18, wherein the housing further comprises second opposing longitudinal grooves in which longitudinal edges of the slider are respectively positioned.

20. The binder apparatus of claim 19, wherein the first opposing longitudinal grooves have a different cross-section than the second opposing longitudinal grooves.

21. The binder apparatus of claim 18, wherein the housing and the slider comprise corresponding retaining structure to retain the slider relative to the housing.

22. The binder apparatus of claim 15, further comprising a binder into which the binder apparatus is coupled.

23. A binder apparatus, comprising:

a housing comprising a plurality of housing structures;

a first carrier rail having a plurality of carrier rail structures that interact with at least some of the plurality of housing structures, the first carrier rail further comprises a first longitudinal edge and a second longitudinal edge, the housing engaging the first longitudinal edge;

a second carrier rail having a third longitudinal edge and a fourth longitudinal edge, the housing engaging the third longitudinal edge, the second longitudinal edge hingably engaging the fourth longitudinal edge; and a lever assembly to longitudinally move at least the first carrier rail, in the first position, a first carrier rail structure of the plurality of carrier rail structures engages a first housing structure of the plurality of housing structures and the first and second carrier rails are in a closed position, in the second position, the first carrier rail structure engages a second housing structure of the plurality of housing structures and the first and second carrier rails are in an open position.

* * * * *

UNITED STATES PATENT AND TRADEMARK OFFICE

CERTIFICATE OF CORRECTION

PATENT NO. : 8,393,819 B2
APPLICATION NO. : 12/945465
DATED : March 12, 2013
INVENTOR(S) : James Warmus It is certified that error appears in the above-identified patent and that said Letters Patent is hereby corrected as shown below:

In the claims

In column 12, line 3 (claim 17), delete "potion" and add --portion--

Signed and Sealed this
Eighteenth Day of February, 2014

Michelle K. Lee

Michelle K. Lee
*Deputy Director of the United States Patent and Trademark Office*